US005219494A

United States Patent [19]

Ambros et al.

[11] Patent Number: 5,219,494

[45] Date of Patent: Jun. 15, 1993

[54] RESISTOR PASTE COMPOSITION AND RESISTOR LAYERS PRODUCED THEREFROM

[75] Inventors: Peter Ambros, Leutershausen; Walter Budig, Wulfershausen, both of Fed. Rep. of Germany

[73] Assignee: Preh-Werke GmbH & Co. KG, Fed. Rep. of Germany

[21] Appl. No.: 525,701

[22] Filed: May 21, 1990

[30] Foreign Application Priority Data

May 24, 1989 [DE] Fed. Rep. of Germany ..... 3-916921

[51] Int. Cl.[5] ..... H01C 7/00; H01C 10/30; H01C 17/06

[52] U.S. Cl. ..... 252/511; 252/512; 252/518; 338/160; 524/495; 524/496

[58] Field of Search ..... 252/511, 512, 518; 524/495, 496

[56] References Cited

U.S. PATENT DOCUMENTS

| | | | |
|---|---|---|---|
| 2,405,449 | 8/1946 | Robinson et al. | 252/502 |
| 3,686,139 | 8/1972 | Lubin | 252/512 |
| 3,930,821 | 1/1976 | Elmer | 427/101 |
| 3,930,822 | 1/1976 | Elmer | 427/101 |
| 4,271,045 | 6/1981 | Steiserwald et al. | 252/503 |
| 4,568,798 | 2/1986 | Ambros et al. | 252/511 |
| 4,600,602 | 7/1986 | Martin et al. | 427/96 |
| 5,111,178 | 5/1992 | Bosze | 338/160 |

FOREIGN PATENT DOCUMENTS

| | | |
|---|---|---|
| 121781 | 10/1984 | European Pat. Off. . |
| 223355 | 5/1987 | European Pat. Off. . |

*Primary Examiner*—A. Lionel Clingman

*Attorney, Agent, or Firm*—Wegner, Cantor, Mueller & Player

[57] ABSTRACT

A paste composition for preparation of electrically resistive layers is described comprising a curable polymer binder in which electrically conductive pigments are dispersed, wherein the composition contains as the electrically conductive pigments a glass-like carbon with a highly unoriented tri-dimensionally cross-linked coil structure.

13 Claims, No Drawings

RESISTOR PASTE COMPOSITION AND RESISTOR LAYERS PRODUCED THEREFROM

BACKGROUND OF THE INVENTION

The invention relates to a pasty electrically resistor composition suitable for preparation of resistive layers, prepared from curable polymer binders having electrically conductive pigments disbursed therein with solvents and, if necessary, with additives. The invention relates further to a resistor layer produced from such resistive composition.

U.S. Pat. No. 3,686,139 describes such a resistive coating paste and resistor elements produced therefrom. To improve service life by resistance to abrasion from wiper contact during use, a selection of heat-curable polymeric material was proposed as a binder for the resistive paste.

Another way to raise the abrasion resistance of resistor layers is suggested in German Application A1-3,638,130. It improves the abrasion properties by admixture of additional agents into the resistive paste.

To reduce the abrasion of resistive layers there is also known the use of pyropolymers as electrically conducting pigment, dispersed into the resistive paste (EP B1 0 112 975, U.S. Pat. No. 4,568,798). This employs hard, fireproof carrier particles, e.g., of aluminum oxide, which are pyrolytically carbonified from the gas phase.

The abrasion resistance of the resistive layer is an essential feature for the service life of an arrangement consisting of a resistive layer. Resistive layers that are not abrasion-resistant lose substance and thereby alter their electrical value. The abraded layer also affects the contact capability of the sliding contact. For some applications, especially in the field of sensors, the abrasion resistance achievable with state-of-the-art methods is not yet adequate.

SUMMARY OF THE INVENTION

It is an object of the invention to prepare a resistive paste of the type described above, from which there can be produced an electrical resistive layer having an improved abrasion resistance and improved stability with respect to environmental influences. The object is attained according to the invention by using as an electrically conductive pigment, a glass-like carbon with a highly unoriented coil structure similar to a tri-dimensional polymer cross-linkage. The glass-like carbon, which is used herein as an electrically conductive pigment, is known (see "Zeitschrift für Werkstofftechnik", Volume 15, pp. 331-338, European Patent Application 0,121,781 or German Application 0 2,718,308). Glassy or glass-like carbon is a special carbon having properties of glass. Its enormous hardness, its smooth and quasi-porefree surface and its isotropy are outstanding properties which distinguish glass-like carbon, for example, from other carbons of amorphous or crystal structure. Examples of items produced from glass-like carbon are laboratory devices, rotors for turbochargers in automobiles and tools for the processing of glass. Because of its high degree of hardness and of the low wettability and dispersability demonstrated in tests, the use of glass-like carbon as an electrically conductive pigment for a resistive paste appeared at first to be of little promise. However, it was now actually found that one can obtain from such a pigmented resistive paste a highly useful abrasion resistant resistor layer. After stressing the resistor layer for 250 hours by sliding contact at a frequency of 40 Hz, no detrimental abrasion was detected. This corresponds to an improvement by a factor of about 100. It was found that commonly used binders are suitable for this purpose.

In contrast to amorphous carbon ordinarily used as a conductive pigment, the glass-like carbon has a smooth, pore-free surface. The lower sensitivity of the resistive layer of the invention to environmental influences, especially moisture, may be the reason. The stability of the electrical values of the resistive layer under the influence of moisture is improved.

DETAILED DESCRIPTION OF THE INVENTION

To obtain resistive layers with varying surface resistance, one changes the percentage of carbon in the resistive paste. The percentage of content of glass-like carbon ordinarily varies between 5 and 80 percent by weight relative to the solid content of the binder.

To raise the microlinearity of the resistive layer to be produced from the paste, various means can be used individually or in combination. For example, it is advantageous to employ a glass-like carbon with a grain size of less than 50 μm. Especially advantageous is the use of spherical carbon particles of mixed grain size, the average value of which should be below 30 μm. In a specially preferred embodiment, glass-like carbon with a diameter of 5-10 μm is employed. Additionally, for resistive surfaces with lower specific conductivity, it is advantageous to add to the resistive paste high-resistance conductive pigments because of the dilution of the pigments. Conventional pigments which can be employed for this purpose include soot, graphite, silver and nickel.

For the production of a resistive layer of film with a low specific conductivity, the paste preferably includes a filler pigmentation with abrasion-proof dielectric material, especially when the concentration of the polymer binder at the surface of the produced resistive layer is to be low. Suitable conventional dielectric filler pigments include titanium dioxide, iron oxide, aluminum oxide, silicon dioxide, talcum and kaolin. Other conventional additives can be used in the resistive paste such as barium sulfate and zinc sulfide.

When the glass-like carbon, prior to its incorporation into the binder, is pyrolytically carbonified, i.e., coated with carbon obtained pyrolytically from the gas phase, it can be wetted and dispersed without difficulty.

The resistive layer produced from the resistive paste is abrasion-proof and has increased resistance to environmental influences.

It is also an object of the invention to provide a resistance paste of the kind described above, which resistance paste maintains its processable consistency for a long period of time. A resistance layer produced from this resistive paste is suitable for use as a fixed resistor or variable resistor, and is electrically stable and resistant to organic substances such as Diesel fuel, gasoline, hydraulic oil and the like within a temperature range of from −55° C. to +160° C.

In a preferred embodiment, the resistive composition comprises a curable polymer binder in which there are dispersed electrically conductive particles, solvents and additives, wherein more than half of the solids contained in the polymer binder consists of (a) fully etherified melamine resins, (b) polyester resins containing hydroxyl groups and (c) an acidic catalyst.

The resins used in the binder should be available in dissolved form (e.g., lacquers) and, after polymerization, form a durable plastic material.

Suitable etherified melamine resins are especially those etherified with $C_1$–$C_6$-alkyl groups, preferably methoxy and ethoxy ethers. Particularly preferred are the melamine-methylol alkyl ether resins. A preferred methoxy derivative is hexamethoxymethylmelamine.

Suitable polyester resins include linear and/or branched saturated polyester resins containing hydroxyl groups and saturated polyesters containing hydroxy and carboxyl groups. Typically, these are resins recognized as desirable complements to melamine resins for the purpose of lattice-like polymerization.

The melamine resin portion ensures the desired stability within a temperature range of from −55° C. to +160° C. By employing fully etherified melamine resins, the melamine resin portion is cross-linked, and is not cured by thermal influence alone but only by the additional influence of a catalyst that is acidic, i.e., that releases protons. The catalyst is, for example, prepared from an organic sulfonic acid.

The polyester resin portion in the mixture determines the hardness or the plasticity of the layer. If the resistive layer is used as a fixed resistor, a certain plasticity is desirable. The hydroxyl groups of the polyester resin are required for cross-linking the polyester resin with the melamine resin. The melamine resin, in combination with the polyester resin, makes the resistance layer resistant to organic substances such as fuels or oils. Solvents suitable in the preparation of the paste are the solvents conventionally used in such pastes and include aliphatic and aromatic hydrocarbons, ethers, esters, ketones, alcohols and chlorinated hydrocarbons.

In a preferred embodiment of the invention, the acidic catalyst is a non-ionogenically blocked catalyst. This catalyst releases acidic groups only at a temperature of about 110° C. and above, which acidic groups initiate the cross-linking of the etherified melamine resin. At temperatures below 110° C., due to blocking, the catalyst, in most cases, has a neutral pH value. Thus, cross-linking of the melamine resin does occur at such temperatures. This is particularly favorable for the processability of the resistance paste, for, as a result, the resistance paste can remain in a processable condition for a long period of time. At room temperature, such mixed resistance paste has a shelf life of half a year and, when stored at +4° C., to have a processability of several years. The blocked catalyst is usually added when the resistance paste is being prepared, while a non-blocked catalyst generally is added to the resistance paste immediately before it is processed.

Preferred catalysts include non-ionogenically blocked acid catalysts of high stability at room temperature, but which show high reactivity in catalyzing lattice-like polymerization at temperatures above 110° C. Among the suitable catalysts are aryl sulfonic acids such as toluenesulfonic acid, dinonylnaphthalene disulfonic acid and dodecylbenzenesulfonic acid.

The mixture advantageously contains a modified ester imide resin such as a terephthalic and/or a isoterephthalic ester imide resin. This enhances the capacity of the resistance paste to be subjected to screen printing. Up to 50% of the solids contained in the polymer binder can consist of a modified ester imide resin. This enhances the flow properties of the resistance paste for screen printing.

Suitable imide resins include imide modified polyaddition resin and polyester imide resins.

In order to make the resistance layer chemically resistant to other substances such as, for example, alcohols, the binder can contain, besides the aforementioned mixtures, a thermosetting epoxy resin, a polyurethane resin, a polyacetal resin, or mixtures thereof.

The curable epoxy resin can be, for example, one prepared from Bisphenol A. The polyurethane resin can be, for example, based on a caprolactam blocked adduct of isophorondiisocyanate. The polyacetal resin can be, for example, a low viscosity polyvinyl butyryl resin.

With the resistance paste described it is possible to produce a resistance layer, for example by means of a reverse laminating process. This process consists in applying a thick layer of resistance paste on an intermediate member and curing it at a temperature of about 230° C. This is followed by its relamination onto the final substrate consisting, for example, of a polyester or an epoxide.

By varying the polymer components of the binding agent, the hardness and flexibility of the layers formed from the binding agent can be controlled, which is of importance with use of flexible substrates.

It is also possible, however, to apply the resistance paste in the form of a thick layer directly onto a film substrate, for example, by means of screen printing and curing the thick layer, for example, at a temperature of about 230° C., for more than an hour.

The invention is described in further detail from the following examples which are designed to illustrate the invention but should not be construed as limiting it in scope.

In the examples, parts are indicated as parts by weight, unless otherwise indicated.

EXAMPLE 1

A resistance paste was produced by mixing the following components:

40 parts of dissolved, fully etherified melamine resins (hexamethoxymethylmelamine) in a 98% solution, e.g., Maprenal MF 900 (Hoechst), 20 parts of oil-free dissolved polyester resin containing hydroxyl groups in a 50% solution, e.g., Aftalat VAN 4284 (Hoechst), 20 parts polyamide resin, e.g., Resistherime A155 (Bayer), 20 parts epoxy resin such as Ruetapox (Bakelite) in 50% solution, 160 parts of glass-like carbon, Sigradur G splinter form, grain size maximum 50 μm (Sigri, Meitingen, Germany), 25 parts butyl glycol, 15 parts of acid catalyst, (e.g., p-toluene sulfonic acid), 2 parts of a levelling agent (e.g., Efca polyacrylate polymer 401, Efca Chemicals, Netherlands).

The coarsely mixed constituents are dispersed in three passes in a 3-roll roller mill. The dispersion is then adjusted for processing viscosity. This can be accomplished by use of butyl carbacyl acetate for silk screen processing, for example. The finished paste, adjusted for processing, is applied as a film to an electrically insulated temperature-tolerant substrate by means of a silk screen printer. This is followed by hardening of the film for an hour at 230° C., whereupon the resistive coating is finished.

If another method is used for processing the resistant paste, e.g., casting, coating, spraying, etc., the processing viscosity must be matched to the selected processing method.

Resistive layers made according to this method are advantageously used as potentiometric sensors for fuel admission to diesel engines.

EXAMPLE 2

The resistance paste is produced as in Example 1 from the following ingredients.

40 parts of dissolved, fully etherified melamine resin (as in Example 1), 40 parts of polyester resin (as in Example 1), 140 parts glass-like carbon (Sigradur G ball form, grain size maximum 10 μm) (Sigri), 12 parts butyl glycol, 4 parts p-toluene sulfonic acid catalyst, 2 parts levelling agent (Efca), 1 part by weight of a dispersing agent such as Anti-Terra-U, a salt of unsaturated polyaminoamides and higher molecular acid esters (BYK-Chemie, Wesel, West Germany).

The resistance layers are useful in potentiometric sensors for air supply to motor vehicles using gasoline.

EXAMPLE 3

A resistance paste is prepared using the following ingredients:

69 parts of glass-like carbon, 50% of which is of splinter form <30 μm and 50% spherical or rounded form <20 μm, 2 parts carbon black, 8 parts phenol resin, 5 parts epoxy modified phenol resin, 5 parts epoxy resin, 8.5 parts isophorone, 10 parts butanone.

The ingredients are mixed in a blender and then ball-milled until the glass-like carbon particles are uniformly dispersed in the resins and solvents to form a flowable plastic coating paste.

Work up corresponding to t he preceding examples yields a resistance layer for an electrical substrate of improved electrical homogeneity.

What is claimed is:

1. A paste composition for preparation of electrically resistive layers comprising a curable polymer binder in which electrically conductive pigments are dispersed, wherein the composition comprises as electrically conductive pigments glass-like carbon with a highly unoriented tri-dimensionally cross-linked coiled structure.

2. A paste composition of claim 1 wherein the glass-like carbon is present in a proportion of 5–80% of the weight of the binder.

3. A paste composition according claim 1, wherein the grain size of the glass-like carbon is smaller than 50 μm.

4. A paste composition according to claim 1, wherein the grain size is about 5 to 10 μm.

5. A paste composition according to claim 3, wherein the glass-like carbon is rounded.

6. A paste composition of claim 1 wherein additional conventional electrically conductive pigments are dispersed.

7. A paste composition according to claim 1, wherein abrasion-proof dielectric filler pigments are dispersed.

8. A paste composition according to claim 1, wherein the glass-like carbon is coated with carbon obtained pyrolytically from the gas phase.

9. A paste composition according to claim 2, wherein the grain size of the glass-like carbon is smaller than 50 μm.

10. A paste composition according to claim 2, wherein the grain is about 5 to 10 μm.

11. A paste composition of claim 9, wherein the glass-like carbon is rounded.

12. A paste composition of claim 10, wherein the glass-like carbon is rounded.

13. A resistor layer prepared from a composition of claim 1.

* * * * *